US005145109A

United States Patent [19]

Faulstick

[11] Patent Number: 5,145,109

[45] Date of Patent: Sep. 8, 1992

[54] UNITARY LIGHT-TIGHT SELF-LOCKING PACKAGE

[75] Inventor: Luke T. Faulstick, Rochester, N.Y.

[73] Assignee: Eastman Kodak Company, Rochester, N.Y.

[21] Appl. No.: 796,745

[22] Filed: Nov. 25, 1991

[51] Int. Cl.[5] ..... B65D 81/30; B65D 85/671

[52] U.S. Cl. ..... 229/145; 206/395

[58] Field of Search ..... 206/316.1, 389, 395–397, 206/455, 456; 229/145–147, 159, 172; 242/71.7

[56] References Cited

U.S. PATENT DOCUMENTS

| | | | |
|---|---|---|---|
| 690,575 | 1/1902 | Herre | 229/145 |
| 1,425,713 | 8/1922 | Stokes | 229/146 |
| 1,994,541 | 3/1935 | Spiking | 229/146 |
| 2,588,377 | 3/1952 | Frankenstein | 229/145 |
| 2,640,642 | 6/1953 | Frankenstein | 229/145 |
| 2,650,015 | 8/1953 | Frankenstein | 229/145 |
| 4,306,687 | 12/1981 | Hadke | 242/55.53 |
| 4,326,634 | 4/1982 | Meyers | 229/145 |
| 4,391,405 | 7/1983 | Drinon | 229/145 |
| 4,405,066 | 9/1983 | Roccaforte | 225/43 |
| 4,417,678 | 11/1983 | Roccaforte | 225/43 |
| 4,645,108 | 2/1987 | Gavin et al. | 225/103 |
| 5,022,524 | 6/1991 | Grady | 206/395 |
| 5,029,709 | 7/1991 | Faulstick | 206/455 |

*Primary Examiner*—Jimmy G. Foster
*Attorney, Agent, or Firm*—C. E. Bailey

[57] ABSTRACT

A unitary, light-tight, self-locking, flip-top package, for securely containing light-sensitive material, which comprises (1) a closable and openable rectanguloid box having bottom, front, rear, and opposite end walls and (2) a mating lid having a top wall movably connected to the box rear wall, with front and opposite end walls depending therefrom in close confronting relation to the corresponding box walls. The box and lid walls are all formed from a single paperboard blank that is specially configured with various panels, flaps, and tabs adapted to be readily folded into close interlocking relationships, to provide a unitary, light-tight, flip-top package which can also be readily unfolded and stored in flat condition for reuse.

3 Claims, 2 Drawing Sheets

UNITARY LIGHT-TIGHT SELF-LOCKING PACKAGE

BACKGROUND OF THE INVENTION

1. Field of the Invention

The present invention relates generally to packaging, and particularly to a light-tight package for securely containing light-sensitive material, such as a roll of photosensitive web material.

2. Description of the Prior Art

Packaging arrangements for containing rolls of web material, including photosensitive web material, are well known in the prior art. Examples may be found in the following patents:

- U.S. Pat. No. 4,306,687 (Hadtke)—Discloses a web-roll dispensing container formed from a single paperboard blank that is so configured and folded as to provide a means for keeping the web-roll centered therein with its outer end projecting from an exit slot.
- U.S. Pat. No. 4,405,066 (Roccaforte)—Discloses a web-roll dispensing container formed from a single paperboard blank that is so configured as to be readily foldable by automated equipment into a securely closed flip-top carton having a reinforced web-cutting edge.
- U.S. Pat. No. 4,417,678 (Roccaforte)—Discloses a web-roll dispensing container formed from a single paperboard blank that is so configured as to be foldable into a sealed flip-top carton having a web-cutting edge and means for readily breaking the flip-top seal.
- U.S. Pat. No. 4,645,108 (Gavin et al.)—Discloses a web-roll dispensing container formed from a single paperboard blank that is so configured as to be foldable into a sealed flip-top carton having self-locking end flaps.
- U.S. Pat. No. 5,022,524 (Grady)—Discloses a rectanguloid flip-top box for securely containing a photosensitive web-roll, the box being formed from a single paperboard blank having various panels and flaps that are foldable into close interfitting relationships.
- U.S. Pat. No. 5,029,709 (Faulstick)—Discloses a rectanguloid flip-top box for securely containing a stack of rectangular photosensitive film sheets, the box being formed from a single paperboard blank having various panels and flaps that are foldable into close interfitting relationships.

While prior-art arrangements such as those described above may have sufficed for their own particular purposes, there has remained, nonetheless, a need for an improved packaging arrangement that is especially adapted for efficient on-line assembly to protectively contain a quantity of photosensitive material, and which also is adapted for convenient opening and light-tight reclosing when in use, and for convenient disassembly to facilitate storage and handling when not in use.

An overall object of this invention, therefore, has been to provide a packaging arrangement that meets the foregoing need, and to do so in a practical, cost-effective, and reliable manner.

SUMMARY OF THE INVENTION

In accordance with that object, and as shown and described herein, the present invention finds utility in a unitary, light-tight, self-locking, flip-top package, for securely containing light-sensitive material, which comprises (1) a closable and openable rectanguloid box having bottom, front, rear, and opposite end walls and (2) a mating lid having a top wall movably connected to the box rear wall, with front and opposite end walls depending therefrom in close confronting relation to the corresponding box walls. The box and lid walls are all formed from a single paperboard blank that is specially configured with various panels, flaps, and tabs adapted to be readily folded into close interlocking relationships, to provide a unitary, light-tight, flip-top package which can also be readily unfolded and stored in flat condition for reuse.

This invention, and its objects and advantages, will become more apparent in the detailed description of a preferred embodiment thereof presented hereinbelow.

BRIEF DESCRIPTION OF THE DRAWINGS

In the detailed description of the preferred embodiment of this invention set forth below, reference is made to the accompanying drawings, wherein like reference characters denote like elements, and wherein.

DESCRIPTION OF THE PREFERRED EMBODIMENT

Because certain parts of packaging arrangements are well known, the following description is directed in particular to those elements forming, cooperating directly with, or relating especially to, this invention. Elements not specifically shown or described herein are selectable from those known in the pertinent art.

Figure 1:
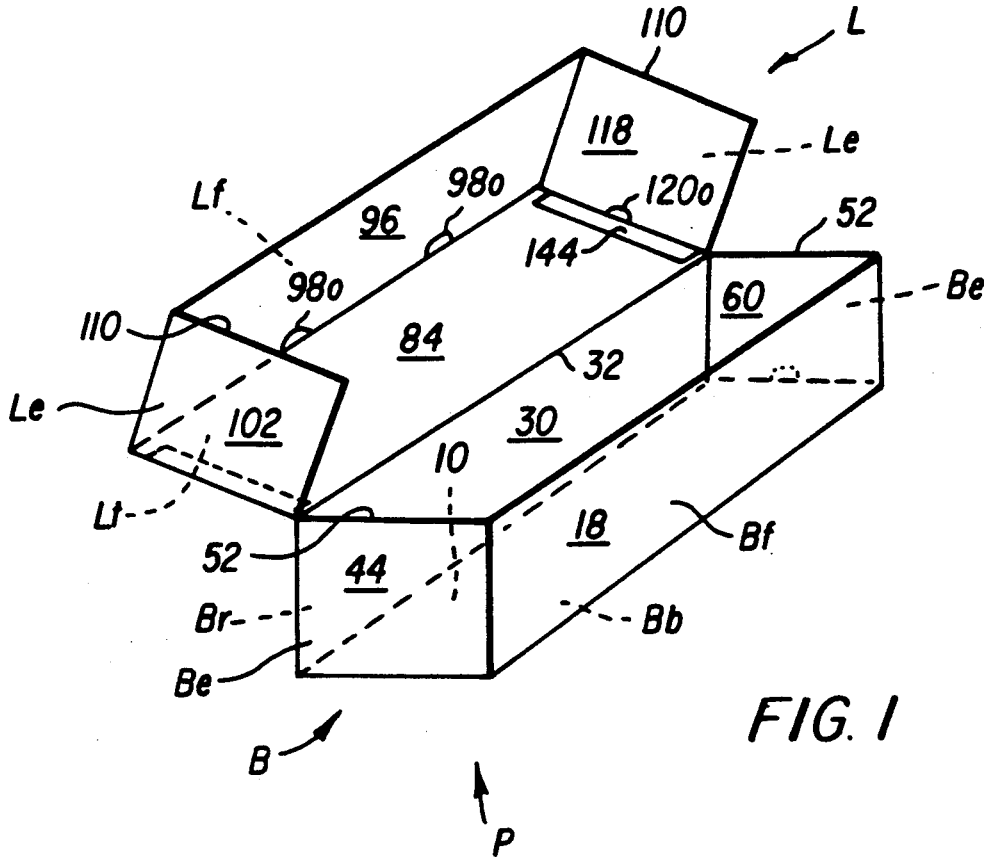
FIG. 1 is a top-front-end perspective view of a light-tight package constructed according to the preferred embodiment, showing that package in an open condition and revealing box and lid components thereof.

Illustrated in FIG. 1 is a unitary, light-tight, self-locking, flip-top package P for securely containing light-sensitive material, such as a roll of photosensitive web material, not shown. The package P comprises (1) a closable and openable rectanguloid box B, the box having a bottom wall Bb, a front wall Bf, a rear wall Br, and opposite end walls Be, and (2) a mating lid L movably connected to the box rear wall Br, the lid having a top wall Lt with a front wall Lf and opposite end walls Le extending perpendicularly therefrom.

Figure 2:
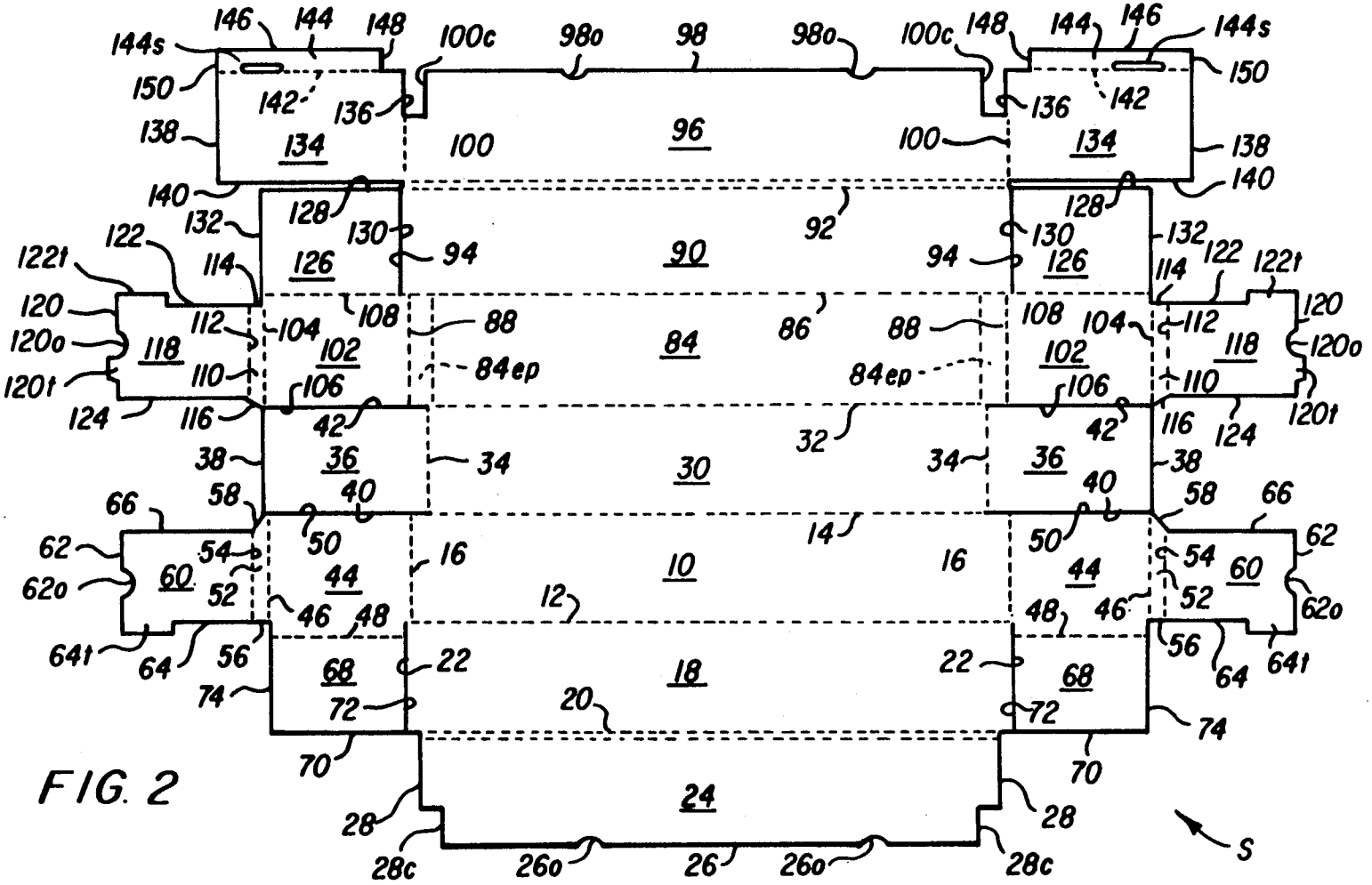
FIG. 2 is a top-plan view of a paperboard blank specially configured to form the package of FIG. 1 in accordance with the preferred embodiment.

The box and lid walls are all formed from a single sheet, or blank, of corrugated paperboard that has been specially configured and creased and/or scored so as to be readily foldable along defined fold lines to provide the light-tight package P. As depicted in FIG. 2, the sheet or blank S includes a plurality of panels, flaps, and tabs that are adapted to be folded about such fold lines into various cooperative interlocking relationships to form the box and lid walls. More particularly, the paperboard blank S comprises the following:

- a rectangular box-bottom-wall panel 10 defined by longitudinal box-bottom-wall front and rear fold lines 12, 14 and transverse box-bottom-wall opposite-end fold lines 16;
- a rectangular box-front-wall outer panel 18 defined by the box-bottom-wall front fold line 12, a longitudinal box-front-wall fold line 20, and transverse box-front-wall outer-panel opposite-end edges 22;

a box-front-wall inner panel 24 defined by the box-front-wall fold line 20, a substantially longitudinal box-front-wall inner-panel bottom edge 26, transverse box-front-wall inner-panel opposite-end edges 28, and box-front-wall inner-panel opposite-end bottom-corner cutouts 28*c*;

a rectangular box-rear-wall panel 30 defined by the box-bottom-wall rear fold line 14, a longitudinal box-rear-wall fold line 32, and transverse box-rear-wall opposite-end fold lines 34;

box-opposite-end-wall intermediate panels 36 defined by the box-rear-wall opposite-end fold lines 34 respectively, transverse box-opposite-end-wall intermediate-panel end edges 38 respectively, and longitudinal box-opposite-end-wall intermediate-panel bottom and top edges 40, 42;

substantially rectangular box-opposite-end-wall outer panels 44 defined by the box-bottom-wall opposite-end fold lines 16 respectively, transverse box-opposite-end-wall outer-panel top fold lines 46 respectively, and longitudinal box-opposite-end-wall outer-panel front fold lines 48 and rear edges 50;

box-opposite-end-wall top panels 52 defined by the box-opposite-end-wall outer-panel top fold lines 46 respectively, transverse box-opposite-end-wall top-panel fold lines 54 respectively, and substantially longitudinal box-opposite-end-wall top-panel front and rear edges 56, 58;

box-opposite-end-wall inner panels 60 defined by the box-opposite-end-wall top-panel fold lines 54 respectively, transverse box-opposite-end-wall inner-panel bottom edges 62 respectively, longitudinal box-opposite-end-wall inner-panel front and rear edges 64, 66, and box-opposite-end-wall inner-panel front-corner tabs 64*t* respectively;

box-front-wall intermediate partial panels 68 defined by the box-opposite-end-wall outer-panel front fold lines 48 respectively, longitudinal box-front-wall intermediate-partial-panel end edges 70 respectively, and transverse box-front-wall intermediate-partial-panel bottom and top edges 72, 74;

a rectangular lid-top-wall panel 84 defined by the box-rear-wall fold line 32, a longitudinal lid-top-wall fold line 86, and transverse lid-top-wall opposite-end fold lines 88, the lid-top-wall panel 84 including opposite-end portions 84*ep* thereof extending inwardly from the lid-top-wall opposite-end fold lines 88;

a rectangular lid-front-wall outer panel 90 defined by the longitudinal lid-top-wall fold line 86, a longitudinal lid-front-wall fold line 92, and transverse lid-front-wall outer-panel opposite-end edges 94;

a lid-front-wall inner panel 96 defined by the lid-front-wall fold line 92, a substantially longitudinal lid-front-wall inner-panel top edge 98, transverse lid-front-wall inner-panel opposite-end fold lines 100, and lid-front-wall inner-panel opposite-end top-corner cutouts 100*c*;

substantially rectangular lid-opposite-end-wall outer panels 102 defined by the lid-top-wall opposite-end fold lines 88 respectively, transverse lid-opposite-end-wall outer-panel bottom fold lines 104 respectively, and longitudinal lid-opposite-end-wall outer-panel rear edges 106 and front fold lines 108;

lid-opposite-end-wall bottom panels 110 defined by the lid-opposite-end-wall outer-panel bottom fold lines 104 respectively, transverse lid-opposite-end-wall bottom-panel fold lines 112 respectively, and substantially longitudinal lid-opposite-end-wall bottom-panel front and rear edges 114, 116;

lid-opposite-end-wall inner panels 118 defined by the lid-opposite-end-wall bottom-panel fold lines 112 respectively, transverse lid-opposite-end-wall inner-panel top edges 120 respectively, lid-opposite-end-wall inner-panel top-edge tabs 120*t* respectively, longitudinal lid-opposite-end-wall inner-panel front and rear edges 122, 124, and lid-opposite-end-wall inner-panel front-corner tabs 122*t* respectively;

lid-front-wall intermediate partial panels 126 defined by the lid-opposite-end-wall outer-panel front fold lines 108 respectively, substantially longitudinal lid-front-wall intermediate-partial-panel end edges 128 respectively, and transverse lid-front-wall intermediate-partial-panel top and bottom edges 130, 132;

lid-opposite-end-wall intermediate panels 134 defined by the lid-front-wall inner-panel opposite-end fold lines 100 respectively, transverse lid-opposite-end-wall intermediate-panel front and rear edges 136, 138, and longitudinal lid-opposite-end-wall intermediate-panel bottom edges 140 and top fold lines 142; and lid-opposite-end-wall intermediate-panel flaps 144 defined by the lid-opposite-end-wall intermediate-panel top fold lines 142 respectively, substantially longitudinal lid-opposite-end-wall intermediate-panel-flap end edges 146 respectively, and transverse lid-opposite-end-wall intermediate-panel-flap front and rear edges 148, 150, the flaps 144 including respective slots 144*s* extending longitudinally therein adjacent to the lid-opposite-end-wall intermediate-panel top fold lines 142 respectively;

As best seen by reference to both FIGS. 1 and 2, the foregoing panels and flaps of blank S are folded about their respective fold lines into various cooperative relationships to form the box and lid walls as follows:

the box-bottom-wall panel 10, as defined by the box-bottom-wall front and rear fold lines 12, 14 and the box-bottom-wall opposite-end fold lines 16, forms the box bottom wall Bb;

the box-rear-wall panel 30 is folded upwardly and forwardly about the box-bottom-wall rear fold line 14 into substantially perpendicular relation to the box-bottom-wall panel 10 to form the box rear wall Br;

the box-opposite-end-wall intermediate panels 36 are folded forwardly and inwardly about the box-rear-wall opposite-end fold lines 34, respectively, toward and into spaced parallel confronting relation with each other;

the box-opposite-end-wall outer panels 44 are folded upwardly and inwardly about the box-bottom-wall opposite-end fold lines 16, respectively, toward and into adjacent parallel confronting relation with the folded box-opposite-end-wall intermediate panels 36 respectively;

the box-opposite-end-wall top panels 52 are folded inwardly and downwardly about the box-opposite-end-wall outer-panel top fold lines 46, respectively, toward and into confronting relation with the folded box-opposite-end-wall intermediate-panel top edges 42 respectively;

the box-opposite-end-wall inner panels 60 are folded downwardly and outwardly about the box-opposite-end-wall top-panel fold lines 54, respectively, toward and into adjacent parallel confronting relation with the folded box-opposite-end-wall intermediate panels 36 respectively;

the box-opposite-end-wall outer, intermediate, inner, and top panels 44, 36, 60, 52, so folded, together form the box opposite end walls Be respectively;

the box-front-wall intermediate partial panels 68 are folded inwardly and rearwardly about the box-opposite-end-wall outer-panel front fold lines 48, respectively, toward and into substantial alignment with each other;

the box-front-wall outer panel 18 is folded upwardly and rearwardly about the box-bottom-wall front fold line 12 toward and into adjacent parallel confronting relation with the folded box-front-wall intermediate partial panels 68;

the box-front-wall inner panel 24 is folded rearwardly and downwardly about the box-front-wall fold line 20, over the folded box-front-wall intermediate-partial-panel top edges 74, and then forwardly toward and into adjacent parallel confronting relation with the folded box-front-wall intermediate partial panels 68;

the box-front-wall outer, intermediate partial, and inner panels 18, 68, 24, so folded, together form the box front wall Bf;

the lid-top-wall panel 84, as defined by the box-rear-wall fold line 32, the longitudinal lid-top-wall fold line 86, and the transverse lid-top-wall opposite-end fold lines 88, forms the lid top wall Lt, but now extends rearwardly from the box rear wall Br in substantially perpendicular relation thereto;

the lid-opposite-end-wall outer panels 102 are folded upwardly and inwardly about the lid-top-wall opposite-end fold lines 88, respectively, toward and into spaced parallel confronting relation with each other;

the lid-front-wall intermediate partial panels 126 are folded inwardly and forwardly about the lid-opposite-end-wall outer-panel front fold lines 108, respectively, toward and into substantial alignment with each other;

the lid-front-wall outer panel 90 is folded upwardly and forwardly about the longitudinal lid-top-wall fold line 86 toward and into adjacent parallel confronting relation with the folded lid-front-wall intermediate partial panels 126;

the lid-front-wall inner panel 96 is folded forwardly and downwardly about the lid-front-wall fold line 92, over the folded lid-front-wall intermediate-partial-panel bottom edges 132, and then rearwardly toward and into adjacent parallel confronting relation with the folded lid-front-wall intermediate partial panels 126;

the lid-front-wall outer, intermediate partial, and inner panels 90, 126, 96, so folded, together form the lid front wall Lf;

the lid-opposite-end-wall intermediate panels 134 are folded rearwardly and inwardly about the lid-front-wall inner-panel opposite-end fold lines 100, respectively, toward and into spaced parallel confronting relation with each other, and then moved forwardly, downwardly, and rearwardly with the lid-front-wall inner panel 96 toward and into adjacent parallel confronting relation with the folded lid-opposite-end-wall outer panels 102 respectively;

the lid-opposite-end-wall intermediate-panel flaps 144, when moved with the lid-opposite-end-wall intermediate panels 134, are folded inwardly and upwardly about the lid-opposite-end-wall intermediate-panel top fold lines 142, respectively, and then moved downwardly toward and into adjacent parallel confronting relation with the lid-top-wall-panel opposite-end portions 84*ep* respectively;

the lid-opposite-end-wall bottom panels 110 are folded inwardly and downwardly about the lid-opposite-end-wall outer-panel bottom fold lines 104, respectively, toward and into confronting relation with the folded lid-opposite-end-wall intermediate-panel bottom edges 140 respectively;

the lid-opposite-end-wall inner panels 118 are folded downwardly and outwardly about the lid-opposite-end-wall bottom-panel fold lines 112, respectively, toward and into adjacent parallel confronting relation with the folded lid-opposite-end-wall intermediate panels 134 respectively;

the lid-opposite-end-wall outer, intermediate, inner, and bottom panels 102, 134, 118, 110, so folded, together form the lid opposite end walls Le respectively; and the lid-top-wall panel 84 then is folded upwardly, forwardly, and downwardly about the box-rear-wall fold line 32 so as to move the folded lid-opposite-end-wall intermediate-panel flaps 144 into adjacent parallel confronting relation with the folded box-opposite-end-wall top panels 52 respectively, the folded lid-opposite-end-wall inner panels 118 into adjacent parallel confronting relation with the folded box-opposite-end-wall outer panels 44 respectively, and the folded lid-front-wall inner panel 96 into adjacent parallel confronting relation with the folded box-front-wall outer panel 18, to move the lid L into closing relation with the box B and thereby form the light-tight package P for securely containing light-sensitive material.

When the various panels and flaps of blank S are folded as described above to form the box and lid of this package, the folded box-opposite-end-wall inner-panel front-corner tabs 64*t* are trapped within the folded box-front-wall inner-panel opposite-end bottom-corner cutouts 28*c* respectively, the folded lid-opposite-end-wall inner-panel front-corner tabs 122*t* are trapped within the folded lid-front-wall inner-panel opposite-end top-corner cutouts 100*c* respectively, and the folded lid-opposite-end-wall inner-panel top-edge tabs 120*t* are trapped within the folded lid-opposite-end-wall intermediate-panel-flap slots 144*s* respectively, all to maintain the box and lid walls in an interlocked condition without need of additional sealing means to hold those walls together.

In the preferred embodiment as illustrated, the front-wall inner-panel top edge 98, the box-opposite-end-wall inner-panel bottom edges 62, and the lid-opposite-end-wall inner-panel top edges 120 each include at least one recessed portion thereof, such as finger openings 26*o*, 98*o*, 62*o*, and 120*o* respectively, to facilitate manual unfolding of the box-front-wall inner panel 24, the lid-front-wall inner panel 96, the box-opposite-end-wall inner panels 60, and the lid-opposite-end-wall inner panels 118 respectively, and thereby permit more efficient storage, transport, and/or disposal of the package in "knocked down" form when no longer needed as a light-tight container.

From the foregoing description, it can now be seen that the aforementioned object of this invention has been met by providing, in a practical, cost-effective, and reliable manner, a unitary, light-tight, self-locking, flip-top package that is especially adapted for efficient on-line assembly to protectively contain a quantity of photosensitive material, and that also is adapted for convenient opening and light-tight reclosing when in use, and for convenient unfolding to "knocked down" form to facilitate storage, transport, and/or disposal thereof when no longer of use.

While the present invention has been described in detail with particular reference to its preferred embodiment illustrated herein, it will be appreciated by those skilled in the art that variations and modifications can be effected within the spirit and scope of this invention as set forth in the following claims.

I claim:

1. A light-tight package for securely containing light-sensitive material, said package comprising a closable and openable rectanguloid box, said box having a bottom wall, a front wall, a rear wall, and opposite end walls, and a mating lid movably connected to said box rear wall, said lid having a top wall with a front wall and opposite end walls depending therefrom, said box and lid walls all being formed from a single sheet of corrugated paperboard including:

a rectangular box-bottom-wall panel defined by longitudinal box-bottom-wall front and rear fold lines and transverse box-bottom-wall opposite-end fold lines;

a rectangular box-front-wall outer panel defined by said box-bottom-wall front fold line, a longitudinal box-front-wall fold line, and transverse box-front-wall outer-panel opposite-end edges;

a box-front-wall inner panel defined by said box-front-wall fold line, a substantially longitudinal box-front-wall inner-panel bottom edge, transverse box-front-wall inner-panel opposite-end edges, and box-front-wall inner-panel opposite-end bottom-corner cutouts;

a rectangular box-rear-wall panel defined by said box-bottom-wall rear fold line, a longitudinal box-rear-wall fold line, and transverse box-rear-wall opposite-end fold lines;

box-opposite-end-wall intermediate panels defined by said box-rear-wall opposite-end fold lines respectively, transverse box-opposite-end-wall intermediate-panel end edges respectively, and longitudinal box-opposite-end-wall intermediate-panel bottom and top edges;

substantially rectangular box-opposite-end-wall outer panels defined by said box-bottom-wall opposite-end fold lines respectively, transverse box-opposite-end-wall outer-panel top fold lines respectively, and longitudinal box-opposite-end-wall outer-panel front fold lines and rear edges;

box-opposite-end-wall top panels defined by said box-opposite-end-wall outer-panel top fold lines respectively, transverse box-opposite-end-wall top-panel fold lines respectively, and substantially longitudinal box-opposite-end-wall top-panel front and rear edges;

box-opposite-end-wall inner panels defined by said box-opposite-end-wall top-panel fold lines respectively, transverse box-opposite-end-wall inner-panel bottom edges respectively, longitudinal box-opposite-end-wall inner-panel front and rear edges, and box-opposite-end-wall inner-panel front-corner tabs respectively;

box-front-wall intermediate partial panels defined by said box-opposite-end-wall outer-panel front fold lines respectively, longitudinal box-front-wall intermediate-partial-panel end edges respectively, and transverse box-front-wall intermediate-partial-panel bottom and top edges;

a rectangular lid-top-wall panel defined by said box-rear-wall fold line, a longitudinal lid-top-wall fold line, and transverse lid-top-wall opposite-end fold lines, said lid-top-wall panel including opposite-end portions thereof extending inwardly from said lid-top-wall opposite-end fold lines;

a rectangular lid-front-wall outer panel defined by said longitudinal lid-top-wall fold line, a longitudinal lid-front-wall fold line, and transverse lid-front-wall outer-panel opposite-end edges;

a lid-front-wall inner panel defined by said lid-front-wall fold line, a substantially longitudinal lid-front-wall inner-panel top edge, transverse lid-front-wall inner-panel opposite-end fold lines, and lid-front-wall inner-panel opposite-end top-corner cutouts;

substantially rectangular lid-opposite-end-wall outer panels defined by said lid-top-wall opposite-end fold lines respectively, transverse lid-opposite-end-wall outer-panel bottom fold lines respectively, and longitudinal lid-opposite-end-wall outer-panel rear edges and front fold lines;

lid-opposite-end-wall bottom panels defined by said lid-opposite-end-wall outer-panel bottom fold lines respectively, transverse lid-opposite-end-wall bottom-panel fold lines respectively, and substantially longitudinal lid-opposite-end-wall bottom-panel front and rear edges;

lid-opposite-end-wall inner panels defined by said lid-opposite-end-wall bottom-panel fold lines respectively, transverse lid-opposite-end-wall inner-panel top edges respectively, lid-opposite-end-wall inner-panel top-edge tabs respectively, longitudinal lid-opposite-end-wall inner-panel front and rear edges, and lid-opposite-end-wall inner-panel front-corner tabs respectively;

lid-front-wall intermediate partial panels defined by said lid-opposite-end-wall outer-panel front fold lines respectively, substantially longitudinal lid-front-wall intermediate-partial-panel end edges respectively, and transverse lid-front-wall intermediate-partial-panel top and bottom edges;

lid-opposite-end-wall intermediate panels defined by said lid-front-wall inner-panel opposite-end fold lines respectively, transverse lid-opposite-end-wall intermediate-panel front and rear edges, and longitudinal lid-opposite-end-wall intermediate-panel bottom edges and top fold lines; and lid-opposite-end-wall intermediate-panel flaps defined by said lid-opposite-end-wall intermediate-panel top fold lines respectively, substantially longitudinal lid-opposite-end-wall intermediate-panel-flap end edges respectively, and transverse lid-opposite-end-wall intermediate-panel-flap front and rear edges, said flaps including respective slots extending longitudinally therein adjacent to said lid-opposite-end-wall intermediate-panel top fold lines respectively;

said box-bottom-wall panel, as defined by said box-bottom-wall front and rear fold lines and said box-bottom-wall opposite-end fold lines, forming said box bottom wall;

said box-rear-wall panel being folded upwardly and forwardly about said box-bottom-wall rear fold line into substantially perpendicular relation to said box-bottom-wall panel to form said box rear wall;

said box-opposite-end-wall intermediate panels being folded forwardly and inwardly about said box-rear-wall opposite-end fold lines, respectively, toward and into spaced parallel confronting relation with each other;

said box-opposite-end-wall outer panels being folded upwardly and inwardly about said box-bottom-wall opposite-end fold lines, respectively, toward and into adjacent parallel confronting relation with said folded box-opposite-end-wall intermediate panels respectively;

said box-opposite-end-wall top panels being folded inwardly and downwardly about said box-opposite-end-wall outer-panel top fold lines, respectively, toward and into confronting relation with said folded box-opposite-end-wall intermediate-panel top edges respectively;

said box-opposite-end-wall inner panels being folded downwardly and outwardly about said box-opposite-end-wall top-panel fold lines, respectively, toward and into adjacent parallel confronting relation with said folded box-opposite-end-wall intermediate panels respectively;

said box-opposite-end-wall outer, intermediate, inner, and top panels, so folded, together forming said box opposite end walls respectively;

said box-front-wall intermediate partial panels being folded inwardly and rearwardly about said box-opposite-end-wall outer-panel front fold lines, respectively, toward and into substantial alignment with each other;

said box-front-wall outer panel being folded upwardly and rearwardly about said box-bottom-wall front fold line toward and into adjacent parallel confronting relation with said folded box-front-wall intermediate partial panels;

said box-front-wall inner panel being folded rearwardly and downwardly about said box-front-wall fold line, over said folded box-front-wall intermediate-partial-panel top edges, and then forwardly toward and into adjacent parallel confronting relation with said folded box-front-wall intermediate partial panels;

said box-front-wall outer, intermediate partial, and inner panels, so folded, together forming said box front wall;

said lid-top-wall panel, as defined by said box-rear-wall fold line, said longitudinal lid-top-wall fold line, and said transverse lid-top-wall opposite-end fold lines, forming said lid top wall, but now extending rearwardly from said box rear wall in substantially perpendicular relation thereto;

said lid-opposite-end-wall outer panels being folded upwardly and inwardly about said lid-top-wall opposite-end fold lines, respectively, toward and into spaced parallel confronting relation with each other;

said lid-front-wall intermediate partial panels being folded inwardly and forwardly about said lid-opposite-end-wall outer-panel front fold lines, respectively, toward and into substantial alignment with each other;

said lid-front-wall outer panel being folded upwardly and forwardly about said longitudinal lid-top-wall fold line toward and into adjacent parallel confronting relation with said folded lid-front-wall intermediate partial panels;

said lid-front-wall inner panel being folded forwardly and downwardly about said lid-front-wall fold line, over said folded lid-front-wall intermediate-partial-panel bottom edges, and then rearwardly toward and into adjacent parallel confronting relation with said folded lid-front-wall intermediate partial panels;

said lid-front-wall outer, intermediate partial, and inner panels, so folded, together forming said lid front wall;

said lid-opposite-end-wall intermediate panels being folded rearwardly and inwardly about said lid-front-wall inner-panel opposite-end fold lines, respectively, toward and into spaced parallel confronting relation with each other, and then moved forwardly, downwardly, and rearwardly with said lid-front-wall inner panel toward and into adjacent parallel confronting relation with said folded lid-opposite-end-wall outer panels respectively;

said lid-opposite-end-wall intermediate-panel flaps, when moved with said lid-opposite-end-wall intermediate panels, being folded inwardly and upwardly about said lid-opposite-end-wall intermediate-panel top fold lines, respectively, and then moved downwardly toward and into adjacent parallel confronting relation with said lid-top-wall-panel opposite-end portions respectively;

said lid-opposite-end-wall bottom panels being folded inwardly and downwardly about said lid-opposite-end-wall outer-panel bottom fold lines, respectively, toward and into confronting relation with said folded lid-opposite-end-wall intermediate-panel bottom edges respectively;

said lid-opposite-end-wall inner panels being folded downwardly and outwardly about said lid-opposite-end-wall bottom-panel fold lines, respectively, toward and into adjacent parallel confronting relation with said folded lid-opposite-end-wall intermediate panels respectively;

said lid-opposite-end-wall outer, intermediate, inner, and bottom panels, so folded, together forming said lid opposite end walls respectively; and said lid-top-wall panel then being folded upwardly, forwardly, and downwardly about said box-rear-wall fold line so as to move said folded lid-opposite-end-wall intermediate-panel flaps into adjacent parallel confronting relation with said folded box-opposite-end-wall top panels respectively, said folded lid-opposite-end-wall inner panels into adjacent parallel confronting relation with said folded box-opposite-end-wall outer panels respectively, and said folded lid-front-wall inner panel into adjacent parallel confronting relation with said folded box-front-wall outer panel, to move said lid into closing relation with said box and thereby form said light-tight package for securely containing light-sensitive material.

2. A light-tight package as claimed in claim 1 wherein said folded box-opposite-end-wall inner-panel front-corner tabs are trapped within said folded box-front-wall inner-panel opposite-end bottom-corner cutouts respectively, wherein said folded lid-opposite-end-wall inner-panel front-corner tabs are trapped within said folded lid-front-wall inner-panel opposite-end top-corner cutouts respectively, and wherein said folded lid-opposite-end-wall inner-panel top-edge tabs are trapped within said folded lid-opposite-end-wall intermediate-panel-flap slots respectively.

3. A light-tight package as claimed in claim 1 wherein said box-front-wall inner-panel bottom edge, said lid-front-wall inner-panel top edge, said box-opposite-end-wall inner-panel bottom edges, and said lid-opposite-end-wall inner-panel top edges each include at least one recessed portion thereof providing a finger opening to facilitate unfolding said box-front-wall inner panel, said lid-front-wall inner panel, said box-opposite-end-wall inner panels, and said lid-opposite-end-wall inner panels respectively.

* * * * *